US007581643B2

(12) United States Patent
Wilskey et al.

(10) Patent No.: US 7,581,643 B2
(45) Date of Patent: Sep. 1, 2009

(54) SYSTEM AND METHOD FOR FOOTWEAR PACKAGING

(75) Inventors: Michael J. Wilskey, Portland, OR (US); Robert B. Leftwich, Portland, OR (US); Shelley D. Zimmer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 816 days.

(21) Appl. No.: 11/064,056

(22) Filed: Feb. 24, 2005

(65) Prior Publication Data

US 2006/0185993 A1 Aug. 24, 2006

(51) Int. Cl.
*B65D 77/04* (2006.01)
*B65D 33/06* (2006.01)

(52) U.S. Cl. ..... 206/736; 206/278; 206/281; 206/459.5

(58) Field of Classification Search ..... 206/279, 206/278, 281, 459, 5, 554.736; 211/34–38; 229/103, 117.35, 120.36
See application file for complete search history.

(56) References Cited

U.S. PATENT DOCUMENTS 2,580,333 A * 12/1951 Allen ..... 229/120.012

(Continued)

FOREIGN PATENT DOCUMENTS

| | | | |
|---|---|---|---|
| DE | 1907692 | A1 | 9/1970 |
| DE | 20013474 | U1 | 11/2000 |
| EP | 0038770 | A1 * | 10/1981 |
| FR | 1596520 | A | 6/1970 |
| GB | 1601102 | A | 10/1981 |
| GB | 2316394 | A | 2/1998 |

OTHER PUBLICATIONS

International Search Report and Written Opinion for PCT/US2006/004085 dated Jul. 4, 2006.

(Continued)

*Primary Examiner*—Sue A Weaver
(74) *Attorney, Agent, or Firm*—Banner & Witcoff, Ltd.

(57) ABSTRACT

Individual pairs of shoes are packaged in bags instead of individual shoe boxes. Each shoe bag can be decoratively printed with, e.g., product logos or other information identifying the manufacturer of the shoes contained in the bag. The bags are made from paper and/or other types of materials. One or more display subunits are used to hold multiple bagged shoe pairs. The display subunits may be used to place shoe bags into shelves designed for shoe boxes, as well as to create free-standing displays.

3 Claims, 21 Drawing Sheets

U.S. PATENT DOCUMENTS

| | | | | | |
|---|---|---|---|---|---|
| 2,615,749 | A | * | 10/1952 | Kuchel | 294/87.1 |
| 3,327,924 | A | * | 6/1967 | Brutting | 383/25 |
| 3,369,660 | A | | 2/1968 | Hartman | |
| 3,653,495 | A | * | 4/1972 | Gray | 206/746 |
| 4,967,913 | A | * | 11/1990 | Bayer | 211/38 |
| 5,054,828 | A | * | 10/1991 | Hantover | 294/1.3 |
| 5,318,223 | A | * | 6/1994 | Gale | 229/120.11 |
| 5,414,975 | A | * | 5/1995 | Hummel | 53/432 |
| D406,478 | S | * | 3/1999 | Rahman | D6/475 |
| 6,129,211 | A | * | 10/2000 | Prakken et al. | 206/750 |
| 6,523,692 | B2 | * | 2/2003 | Gregory | 206/746 |
| 6,905,027 | B2 | * | 6/2005 | Galter | 206/749 |
| 2002/0162815 | A1 | * | 11/2002 | Wang | 211/194 |

OTHER PUBLICATIONS

Stuart Hart, Ted London, Heather McDonald, "Expanding the Playing Field: Nike's World Shoe Project Teaching Note"; date of first publication unknown, but copyright 2002; 16 pages.

Heather McDonald, Ted London, "Expanding the Playing Field: Nike's World Shoe Project (A)"; date of first publication unknown, but copyright 2002; 19 pages.

Information Disclosure Statement and Comments Regarding Prefiling Activities, with attached photo; 3 pages.

* cited by examiner

SYSTEM AND METHOD FOR FOOTWEAR PACKAGING

FIELD OF THE INVENTION

This invention relates to packaging. In particular, this invention relates to packaging of footwear, both for transportation and for retail sales purposes.

BACKGROUND OF THE INVENTION

Traditionally, individual pairs of shoes have been sold in shoe boxes. Although the style and size of shoe boxes can vary widely, most include a cardboard box sufficiently large to hold two shoes, as well as a box cover or lid. FIG. 1A shows one existing type of shoe box used for, e.g., a pair of athletic shoes. Box 1 of FIG. 1A includes an attached (or "clam shell") top 2 and a bottom 3. Shoes 4 and 5 (shown in silhouette with uneven broken lines) are typically placed into box 1 with the soles and rears of the shoes facing the box sides. Box 1 would typically be formed from corrugated fiber board, cardboard or other similar material. In particular, and as shown in FIG. 1B, a pattern 6 for box 1 is cut from a blank and then folded into the configuration shown in FIG. 1A. Although the size of the pattern would depend on the desired size of the shoe box, a typical pattern would be cut from a blank having a height (h) of approximately 26½ inches and a width (w) of approximately 26⅞ inches (approximately 4.95 square feet of cardboard). When shipping multiple pairs of shoes (from, e.g., a manufacturer or a distribution center to a retail store), boxed shoe pairs are placed in a larger box. This larger box is often referred to as an MOC ("master outer carton"), also known as a secondary package or as a distribution package. FIG. 2 shows an MOC 7 used for shipment of individual shoe pairs contained in boxes such as box 1 (FIG. 1A).

Packaging each pair of shoes in an individual box presents numerous disadvantages. As is clear from FIG. 1B, a significant amount of cardboard or other material is needed for each shoe box, resulting in substantial material expense. Use of shoe boxes is often not an environmentally-friendly practice. Although many shoe boxes can be recycled, consumers may fail to do so.

Shoe boxes also present problems at the retail store level. In many modern self-service shoe stores, a customer is able to select a box of shoes from a shelf. The customer may then remove the shoes from a selected box and try those shoes on. Although many stores attempt to arrange shoe boxes in an orderly manner so that a customer can easily find a desired type of shoe, the orderly arrangement may quickly disappear during busy shopping hours. Customers are then forced to open multiple boxes to find the desired shoes. Customers may then leave these multiple opened boxes lying about, further compounding the problem. When shoes are re-boxed they may be put in the wrong boxes, causing still more confusion for later customers.

Shoe boxes can also be an inconvenience to sales personnel in traditional shoe stores. In these types of stores, a customer usually identifies a particular shoe from a display, and a salesperson then retrieves an appropriately-sized pair from a storage room. When searching a storage room for a pair of shoes requested by a customer, the salesperson may be forced to open multiple shoe boxes. For example, a particular type of shoe may be available in several colors. The color may not be indicated on the box, or may not be indicated on a part of the box that is easily viewable. In order to find a shoe pair of the proper color, the sales person must potentially open multiple boxes.

Shoe boxes also increase the amount of space associated with each shoe pair. In other words, once placed into a shoe box, a pair of shoes occupies a larger volume. If the amount of space associated with pairs of shoes could be reduced, shipping and storage costs could potentially be reduced. Moreover, reducing the amount of space required for each pair of shoes could allow shipping more shoe pairs within a given volume, potentially increasing shipping efficiency and reducing fuel consumption.

For these and other reasons, there remains a need for improved systems and methods for footwear packaging.

SUMMARY OF THE INVENTION

In at least some embodiments of the invention, material expenses and environmental concerns are ameliorated through placement of shoe pairs into bags instead of individual shoe boxes. Each shoe bag can be decoratively printed with, e.g., product logos or other information identifying the manufacturer of the shoes contained in the bag. The bags may be made from paper and/or from other types of materials. In some embodiments, the invention further includes one or more display subunits for holding multiple bagged shoe pairs. The display subunits may be used to place shoe bags into shelves designed for shoe boxes, as well as to create free-standing displays.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

DETAILED DESCRIPTION OF THE PREFERRED EMBODIMENTS

In at least some embodiments of the invention, shoe pairs are not placed in individual shoe boxes. Instead of placing shoes into relatively expensive and environmentally-wasteful boxes, shoe pairs are placed into bag-type retail packages. As can be appreciated from the description to follow, use of bags instead of boxes substantially reduces the amount of packaging material used for each pair of shoes. Thus, even if consumers fail to recycle those bags after purchasing shoes, the amount of unrecycled material is significantly reduced. Because less material is needed to manufacture a bag than is needed to manufacture a shoe box, packaging expense can be reduced. This cost savings also permits use of graphics and other design features for shoe bags which could be prohibitively expensive if used with shoe boxes. Additional features and advantages are described below.

Figure 3:
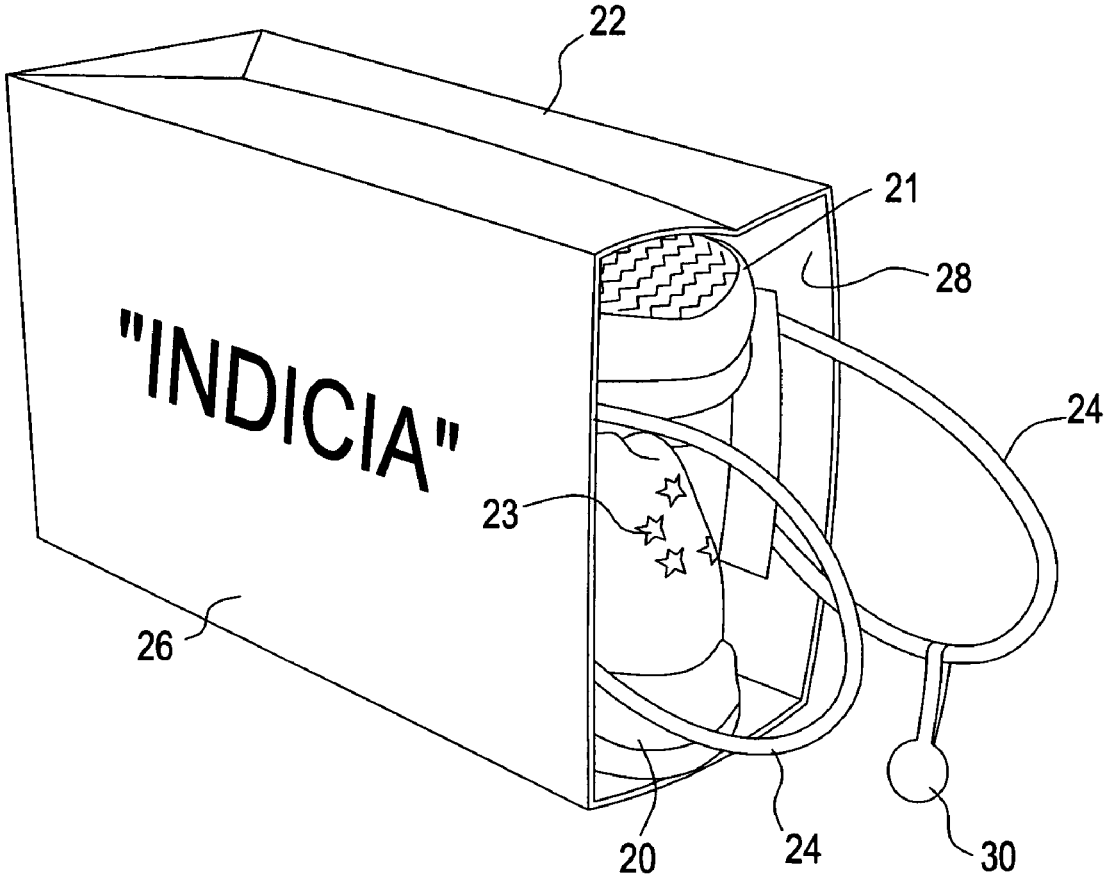
FIG. 3 shows a pair of shoes inside of a retail shoe package according to at least some embodiments of the invention.

FIG. 3 shows one example of a pair of shoes 20 packaged according to at least some embodiments of the invention. A pair of shoes 20 is contained inside of a bag 22. Bag 22 is the retail package in which shoe pair 20 is sold to a consumer. The shoes of shoe pair 20 are nested in a toe-over-ankle configuration. In other words, the shoes are arranged such that their uppers are facing one another, with the toe of one shoe located over the ankle collar of the other shoe. A toe 21 of one shoe and a heel 23 of the other shoe are visible. Bag 22 includes handles 24. Bag 22 has an exterior 26 which may be printed with graphic material (e.g., a product logo or other brand information), which graphic material is generically represented in certain of the drawings with the word "indicia". The mouth 28 of bag 22 is reinforced so as to maintain mouth 28 in an open configuration exposing shoe pair 20. The reinforcement also protects mouth 28 as shoe pair 20 is inserted into bag 22. A hang tag 30 may also be added to one of handles 24 and used for, e.g., pricing information, product (i.e., brand and/or model) name, product number, shoe size, information about shoe color, an SKU number, a UPC bar code, etc. In other embodiments, tag 30 could be attached to other parts of bag 22 (i.e., the edge of the opening), to one of the shoes in the bag or to another location, or omitted. In some embodiments, hang tags could be affixed to both the bag and to one (or both) of the shoes in the bag. In other embodiments, tag 30 is rectangular and approximately ½" by 2" in size. In some embodiments, the tag may actually form one of the bag handles (e.g., a ribbon shaped tag could replace one of handles 24).

In at least some embodiments, tag 30 is (or includes) an RFID (radio frequency identification) tag. An RFID tag could also be included elsewhere in the package, such as in or on one of the shoes, or elsewhere in (or on) bag 22. An RFID tag can contain information about the shoes in a package, such as size, style, country of manufacture, factory, color, etc. Using RFID tags, information about the number and type(s) of shoe pairs in an MOC could be ascertained without opening the MOC. Such a system would also enable arranging the shoe pair packages in the MOC for maximum efficiency rather than with all sides pointing in the same direction.

Bag 22 may be made from any of various types of materials. In at least some embodiments, bag 22 is made from recyclable, colored kraft paper having cross-hatched fiber lay down with cross-directional tear resistance. In other embodiments, bag 22 is made from multi-ply paper and/or is of a multi-wall paper construction. For packages where a higher quality finish on exterior 26 is desired, numerous options are available. In some embodiments, for example, bag 22 is fabricated from kraft paper having a clay coating on at least one face. In other embodiments, bag 22 is made from a multi-wall paper having a higher quality paper on the face which becomes exterior 26 (e.g., white paper on the exterior 26 of bag 22, with kraft paper on the interior). Other high grade papers could also be used. Paper used to form bag 22 can be printed using any of various methods. In certain embodiments, paper for bag 22 is printed using flexographic printing with in-line aqueous coating. Oil-based, ultraviolet (UV) cured coatings may also be used. In applications where higher quality graphics are desired for exterior 26, lithographic printing may be used. In many cases, however, higher cost lithography is unnecessary. In particular, a given printing technique will often produce higher quality printing on paper than on cardboard or other stiff materials. Thus, flexographic techniques currently used to print shoe boxes should yield higher quality results when used to print shoe bags. Of course, printing techniques other than flexography and lithography can be used.

Other possible bag materials include SBS (solid-bleached sulfate) bag stock, grocery bag stock, etc. Bag 22 could also be made from materials other than paper. Examples include hemp, polypropylene laminate, polymer materials made from high density polyethylene fibers (such as the material sold under the trade name TYVEK by E.I. du Pont de Nemours and Company of Wilmington, Del.), other types of polymer materials, various fabrics and textile materials (including recycled textile or fabric materials), and metallic foils. Combinations of different materials may also be used. In some embodiments, handles 24 are formed from 100% recycled twisted paper. Other types of handles could be used; examples of other handle types are described below. Hang tag 30 is preferably manufactured from TYVEK or paper, but could likewise be made from numerous other materials.

Figure 4A:
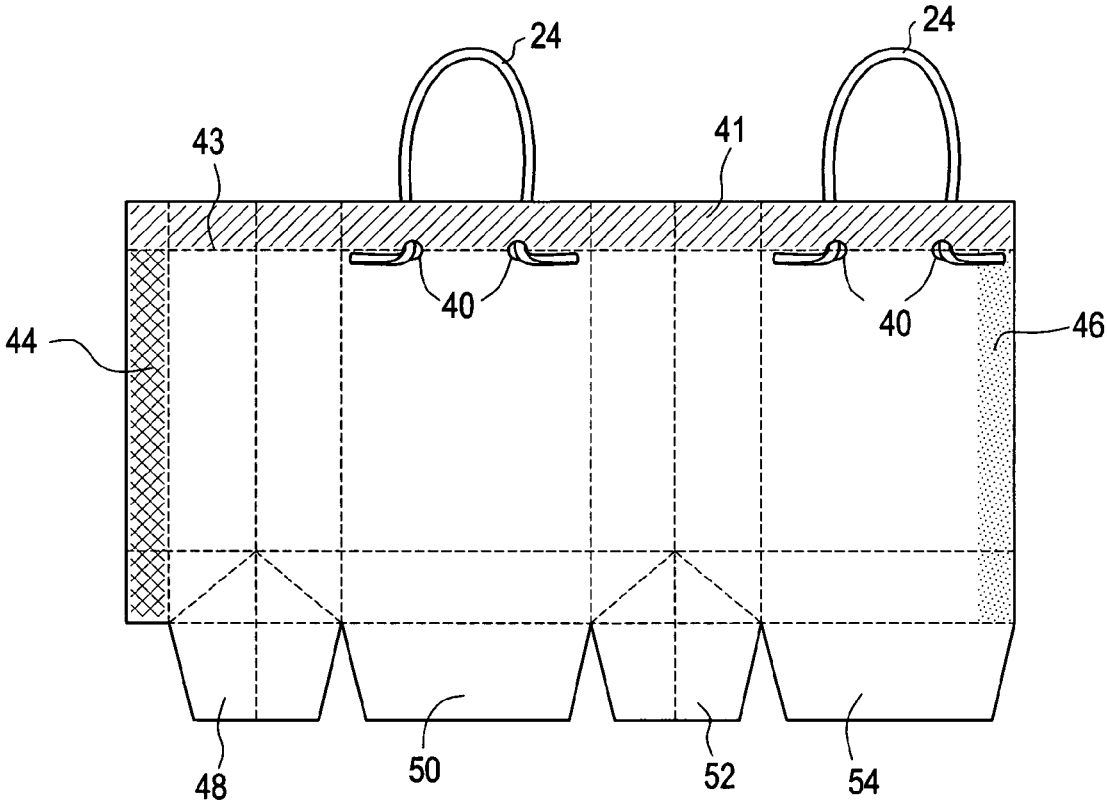
FIGS. 4A and 4B show paper patterns used to create retail shoe packages.
Figure 4B:
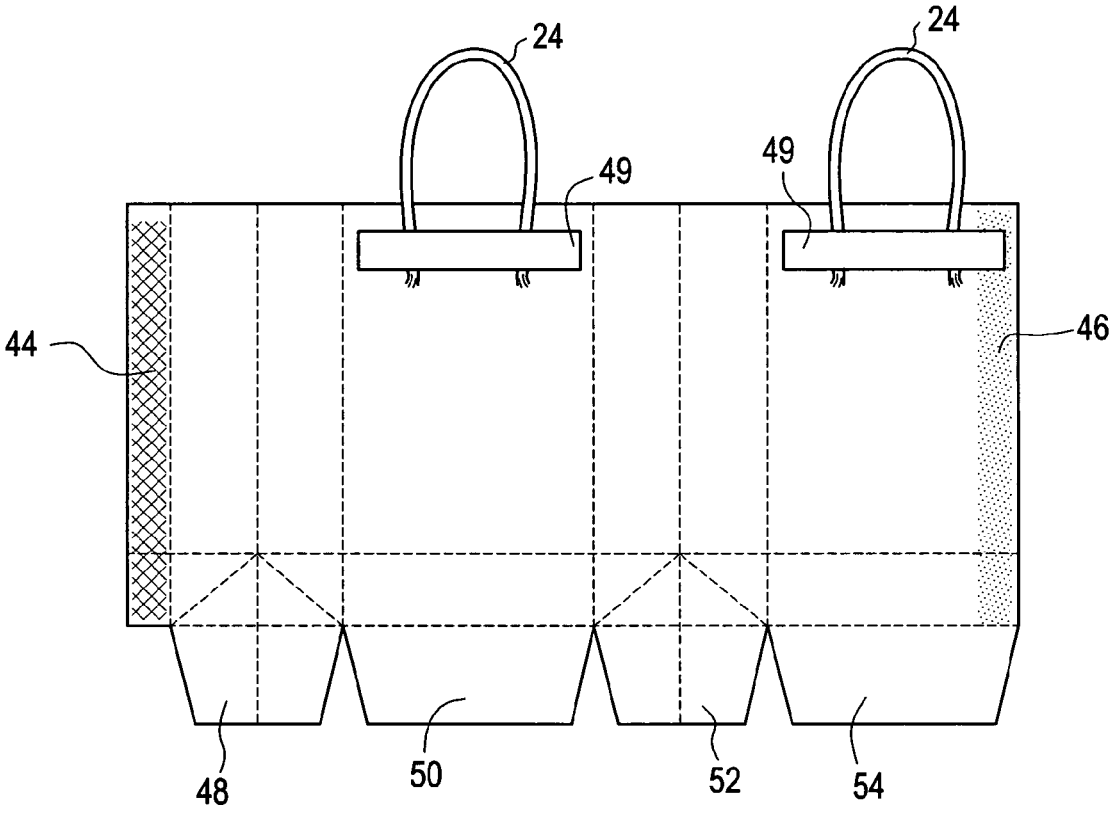

FIG. 4A shows a paper pattern prior to folding and gluing to create bag 22. FIG. 4A shows the face of the paper material which will become the inside of a bag 22. Ends of handles 24 are placed into holes 40. Upper region 41 (shown with single line cross hatching) is folded over along fold line 43 and glued in place. This secures handles 24 in place and forms the reinforcement for mouth 28 (FIG. 3). Flap 44 (shown with double-line cross-hatching) is then glued to region 46 on the opposite end and other face of the bag pattern (shown with stippling). Flaps 48, 50, 52 and 54 are then overlapped and glued to form the bottom of bag 22. The remaining unnumbered broken lines in FIG. 4A represent fold lines for the completed bag. In some embodiments, handles 24 are simply taped to the inside face of the bag material by a strip of adhesive tape 49 (or alternative adhesive-backed material), as shown in FIG. 4B. As also shown in FIG. 4B, folding over of the upper edge of the bag pattern can be omitted. Although the size of a bag pattern will vary, an example size is approximately 24 inches by 15.75 inches.

Figure 5A:
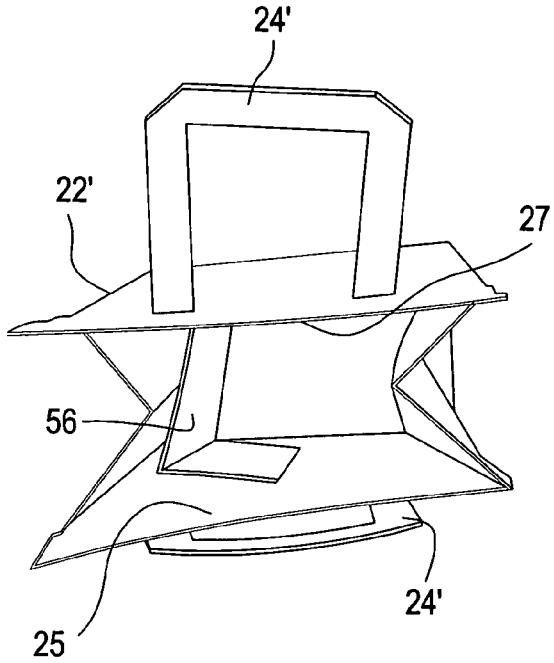
FIGS. 5A-5C show retail shoe packages according to alternate embodiments of the invention.
Figure 5B:
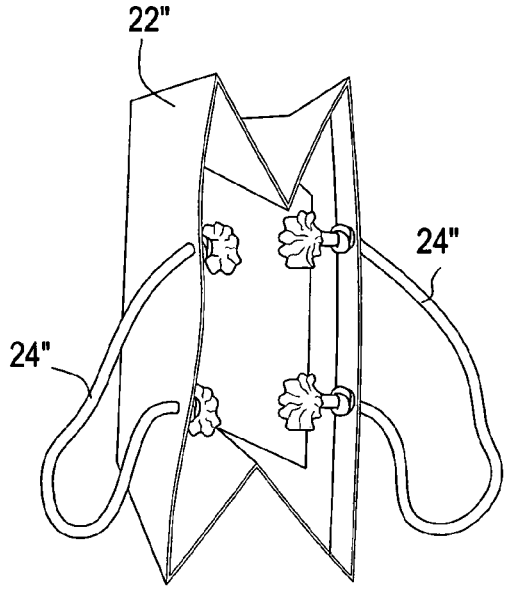
Figure 5C:
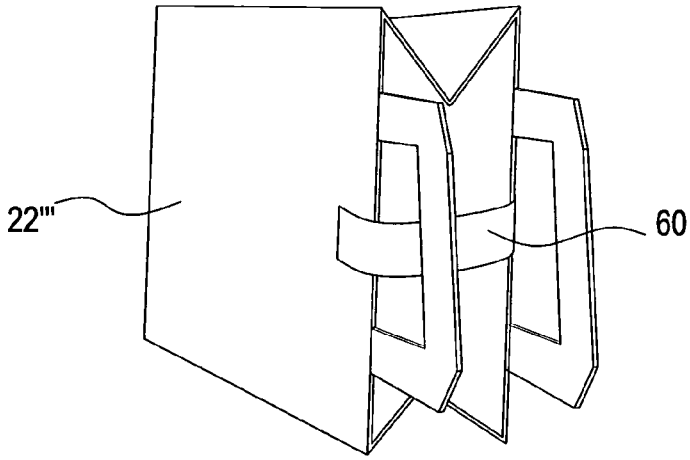

FIGS. 5A-5C show additional embodiments of bag 22. In FIG. 5A, bag 22' includes a divider 56. Divider 56 separates shoes placed inside of bag 22' and prevents those shoes from rubbing against one another. For some types of shoe materials, excessive movement of the two shoes against each other may result in scratching or other marring of the shoes' surfaces. In conventional shoe box packaging, this rubbing motion is reduced by wrapping tissue paper around one or both shoes. Divider 56 minimizes and/or avoids the need for such wrapping. Divider 56 also serves to provide additional stabilization of shoes when being transported in bulk within an MOC, such as is described below. Divider 56 is formed by an additional paper panel inserted into bag 22'; flaps of the divider panel may be glued to opposite internal faces 25 and 27 of bag 22'. FIG. 5A also shows an alternative handle construction. In FIG. 5A, paper handles 24' are attached to bag 22'. In FIG. 5B, rope handles 24" are used for bag 22". In FIG. 5C, a closure 60 is added to bag 22'". Although closure 60 reduces the viewability of shoes within bag 22'", use of closure 60 may be desired under certain circumstances. For example, a closure could be added where additional dust protection is desired for packaged shoes.

Figure 6A:
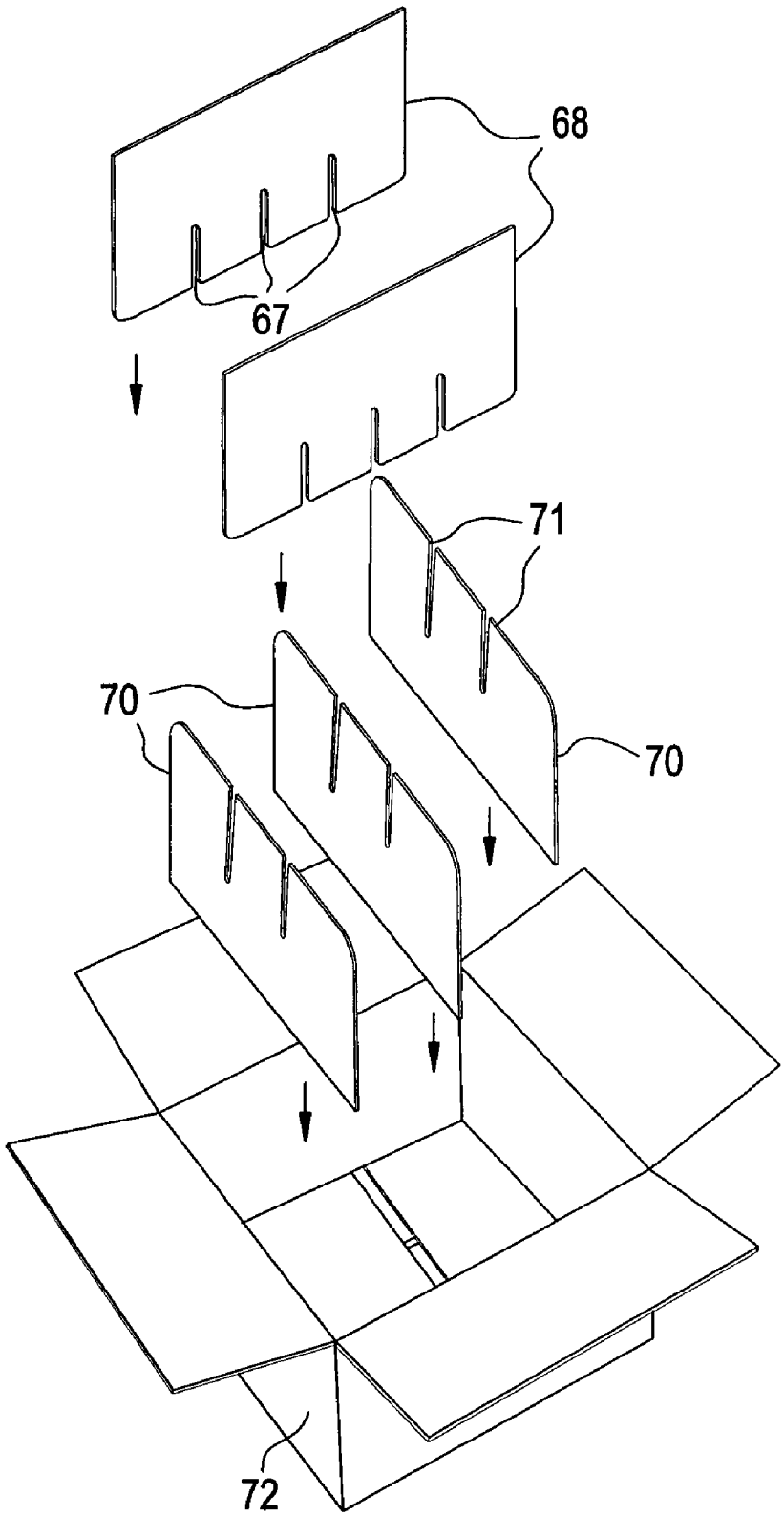
FIGS. 6A-6C show placement of shoes and retail shoe packages, according to at least some embodiments of the invention, into an MOC.
Figure 6B:
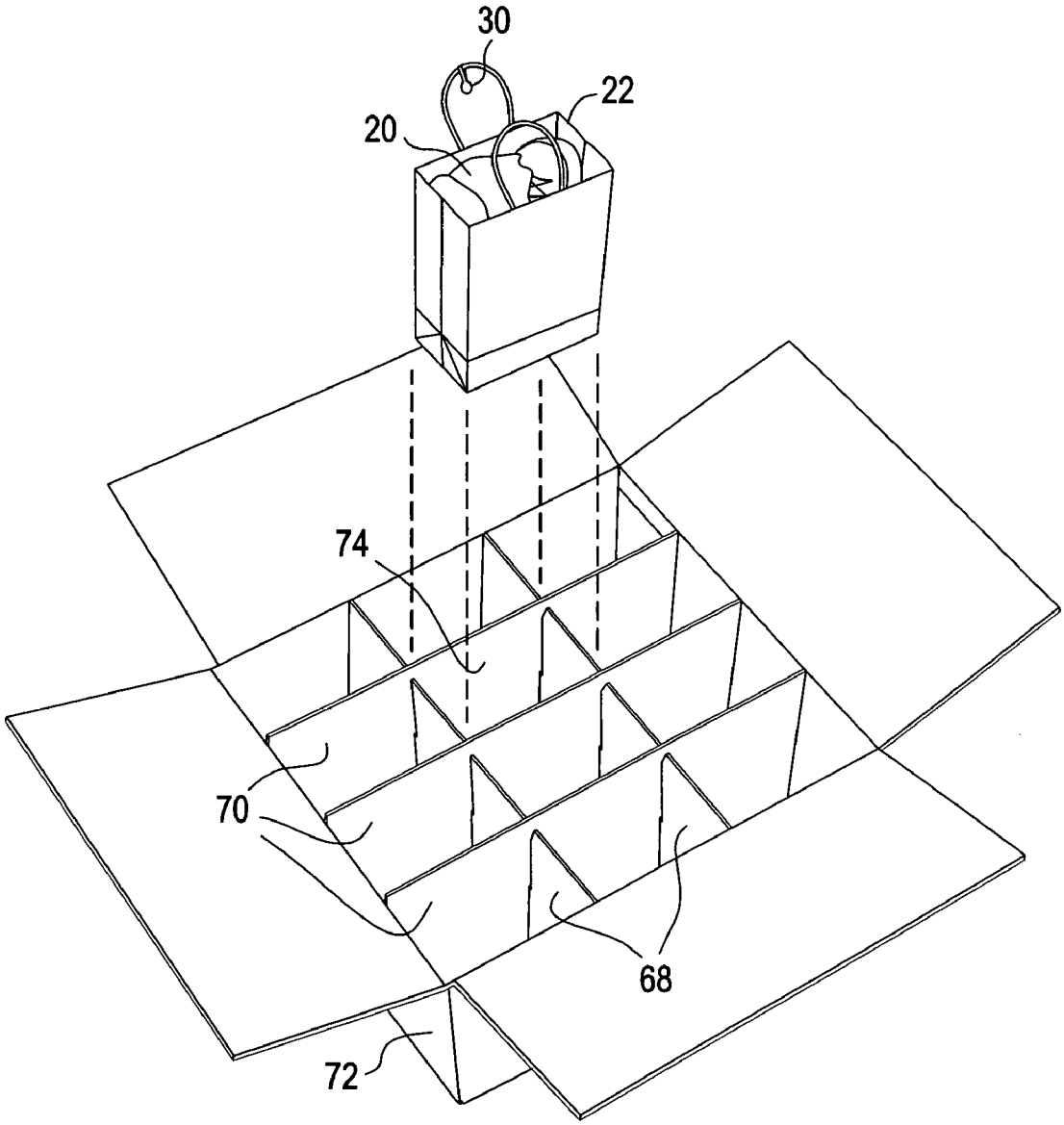
Figure 6C:
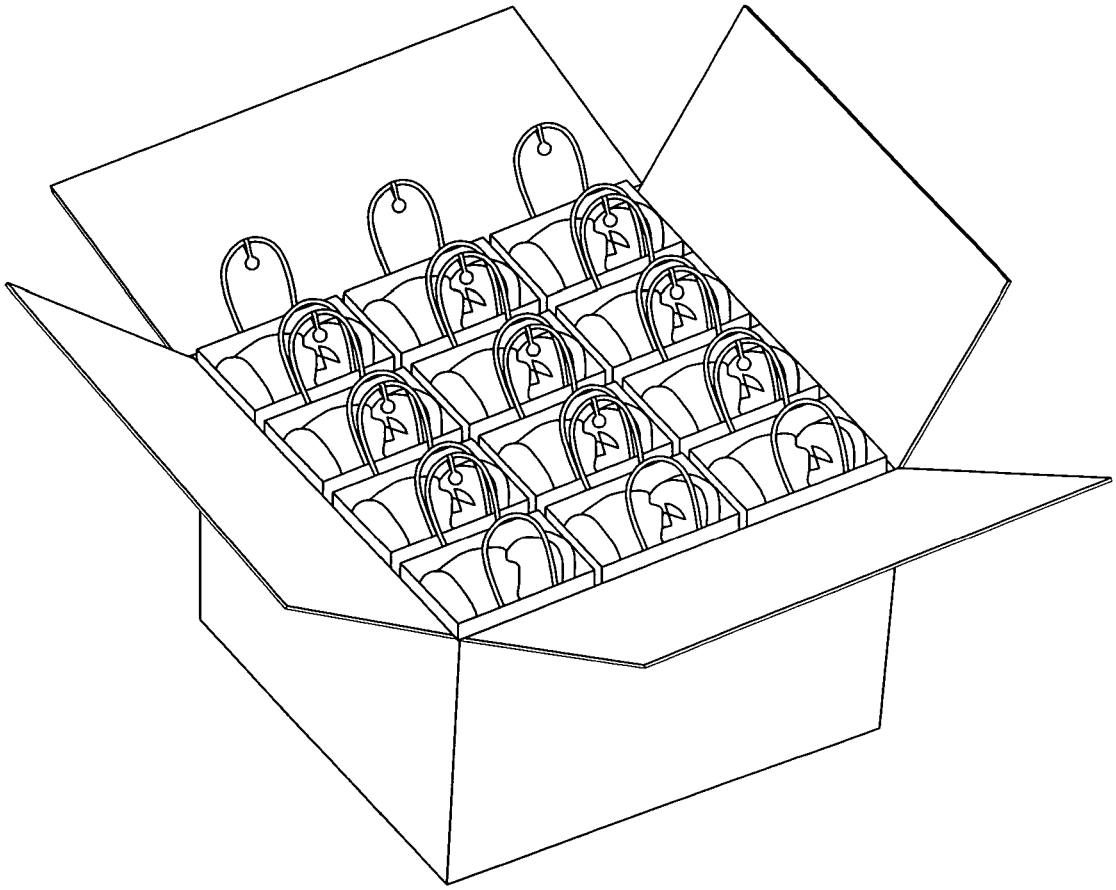

FIGS. 6A-6C show placement into an MOC of shoe pairs contained within packages such as in FIG. 3. As shown in FIG. 6A, dividers 68 and 70 are placed within MOC 72. Dividers 68 and 70 may be stamped from cardboard or other suitable material. Dividers 68 and 70, which operate as is known in the prior art, have slots 67 and 71 formed in opposing edges. The upwardly-facing slots 71 of dividers 70 receive the downwardly-facing slots 67 of dividers 68 so as to hold dividers 68 and 70 in a perpendicular arrangement, thereby forming an array of cells 74 (FIG. 6B). FIG. 6B also shows a bag 22 holding a pair of shoes 20 and being placed within one of the cells 74 formed by dividers 68 and 70. In FIG. 6C, all cells of MOC 72 have been filled, and MOC 72 is now ready for closure and subsequent transport. Of course, the procedure of FIGS. 6A-6C is not the only manner in which an MOC 72 may be filled. For example, a bag 22 could first be placed into each of cells 74, with shoe pairs 20 then placed into those bags.

Figure 1A:
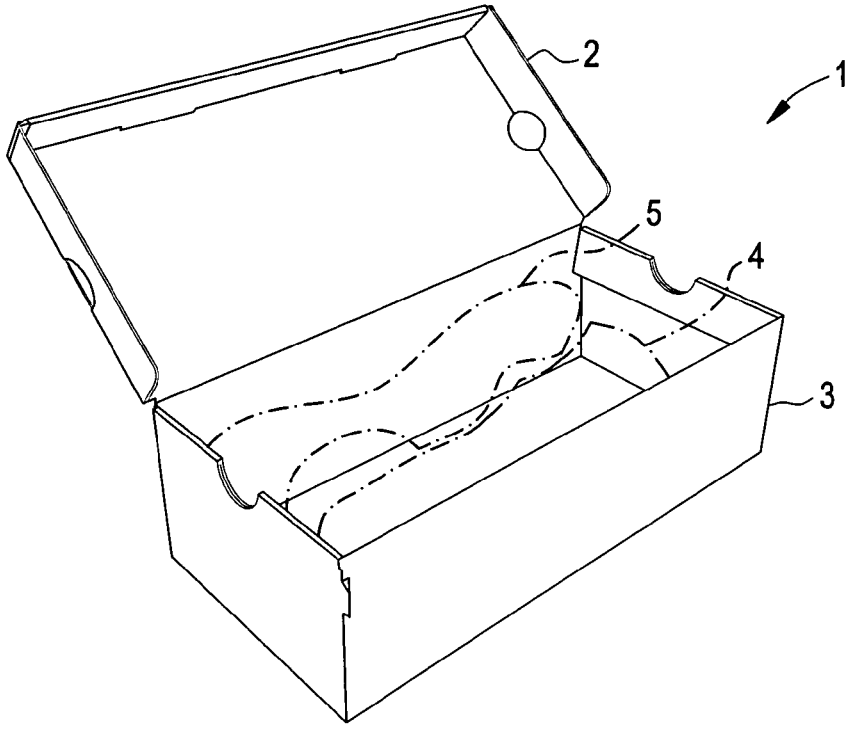
FIG. 1A PRIOR ART
FIGS. 1A and 1B show, respectively, a prior art shoe box and a blank for that box.
Figure 1B:
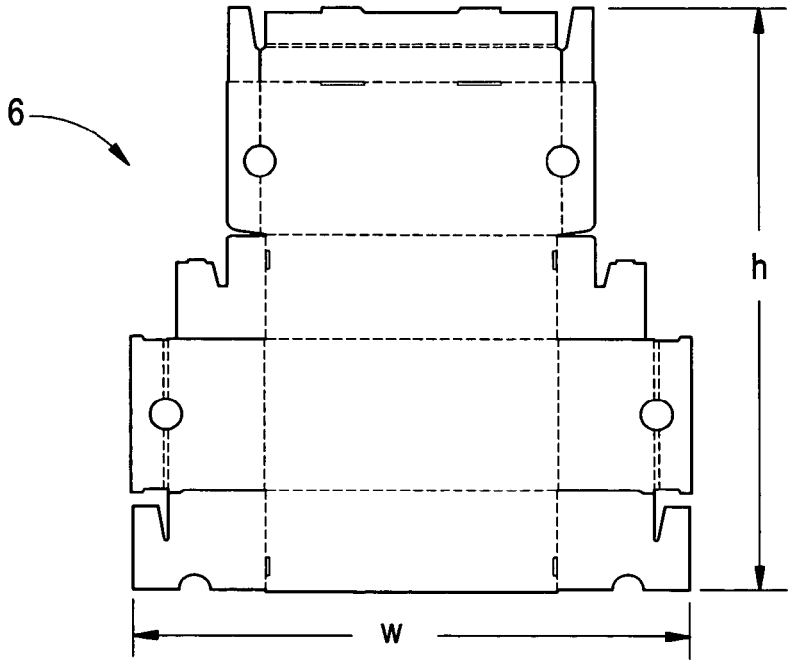
FIG. 1B PRIOR ART
Figure 2:
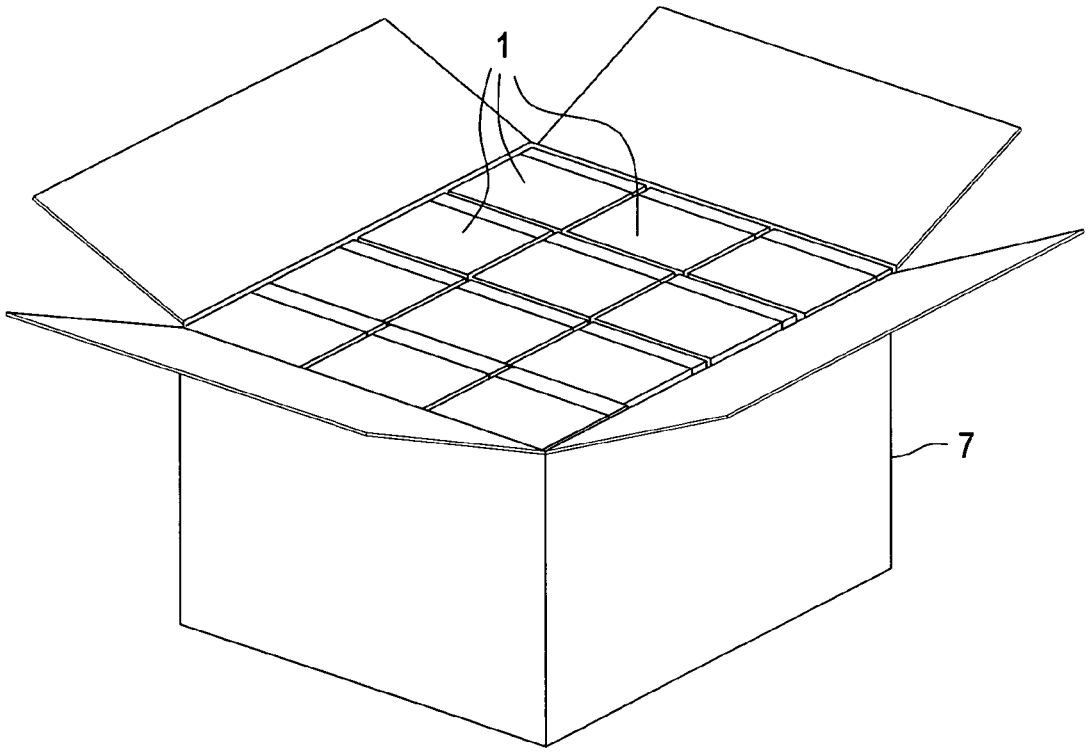
FIG. 2 PRIOR ART
FIG. 2 shows a prior art master outer carton (MOC).

Notably, the use of MOC dividers is not required. However, additional structural rigidity and inter-package isolation may be desirable under certain circumstances. For example, individual shoe bags may in some cases be made from materials which are more susceptible to damage if allowed to rub against other bags. As another example, it may be necessary to stack multiple MOCs on top of one another during shipping and/or storage. Addition of dividers 68 and 70 provides additional structure to withstand increased loading. Although inclusion of dividers 68 and 70 may represent added packing materials that are not typically needed when placing prior art shoe boxes within an MOC (see FIG. 2), the cost and environmental advantages of the invention are still present. Even if dividers are used to separate individual bags within an MOC, the total amount of materials needed to form those dividers and bags is still less than the amount of material used to create individual boxes. Because dividers (unlike individual shoe boxes) are typically not printed, they are relatively inexpensive. Moreover, material used to form MOC dividers is more likely to be recycled than is material used to form shoe boxes. In particular, retail stores will typically dispose of MOC divider material as those MOCs are unpacked. Unlike most individual consumers, retail businesses typically deal with large volumes of cardboard and have an economic incentive to recycle that cardboard.

Figure 7:
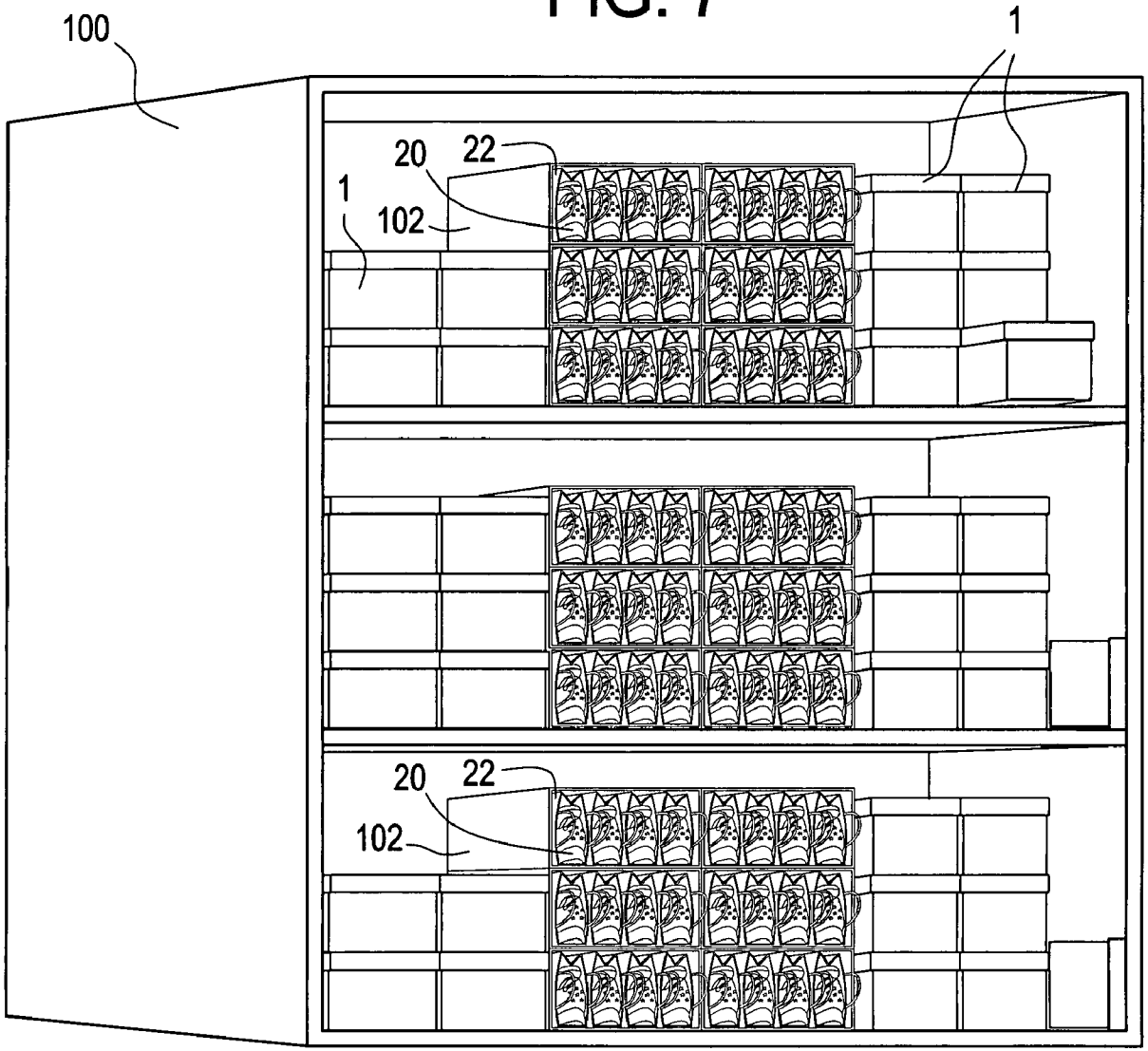
FIG. 7 shows a retail display of shoes, packaged according to some embodiments of the invention, alongside shoes packaged according to the prior art.

As previously indicated, placing shoe pairs in bags offers additional advantages over conventional shoe box packaging. One such advantage is illustrated in FIG. 7. FIG. 7 shows a display 100 such as might be found in a modern self-service footwear store. In such a store, consumers are able to select a pair of shoes from shelves or other type of display. Display 100 contains both conventionally-packaged shoes (i.e., with each pair in a shoe box 1) and shoe pairs packaged in bags 22 according to various embodiments of the invention. As is evident in FIG. 7, shoe pairs inside of the conventional shoe boxes are not viewable. In order to see what is in one of those shoe boxes, the customer must remove the box from the shelf and open it. Although many conventionally-packed shoes may provide the shoe style, color and/or other information on the shoe box, the location of this information is generally not standardized. Unless a consumer is familiar with the labeling practices of a given shoe manufacturer, the customer will often have to search for the desired information on the shoe box. Moreover, the names that each manufacturer assigns to a particular shoe style and/or color sometimes fail to intuitively provide needed information about the product. For example, a white pair of shoes with blue markings could have color descriptions such as "white/lapis," "ivory/cobalt," "bone/blue," etc. For these and other reasons, many consumers remove and open numerous shoe boxes when attempting to find a desired pair of shoes. In addition to inconveniencing shoe-buying consumers, this often results in unsightly and unorganized display areas.

An advantage of the depicted embodiment is that the shoe pairs 20 in bags 22 are at least partially visible. A shopper can thus readily determine which package may have a desired shoe style and/or color without needing to first remove the package from the display. Additional information about each shoe pair (e.g., pricing, size, etc.) can be readily found on a hang tag attached to a handle (or other part) of each shoe package, or on the package itself. The advantages demonstrated in FIG. 7 would likewise be available in a shoe store in which sales personnel retrieve shoes from a storeroom. Storeroom shelves are often similar to display 100 of FIG. 7. A salesperson searching for a pair of shoes could more easily see a needed pair of shoes if that pair is packed in a bag instead of in a box.

Figure 8A:
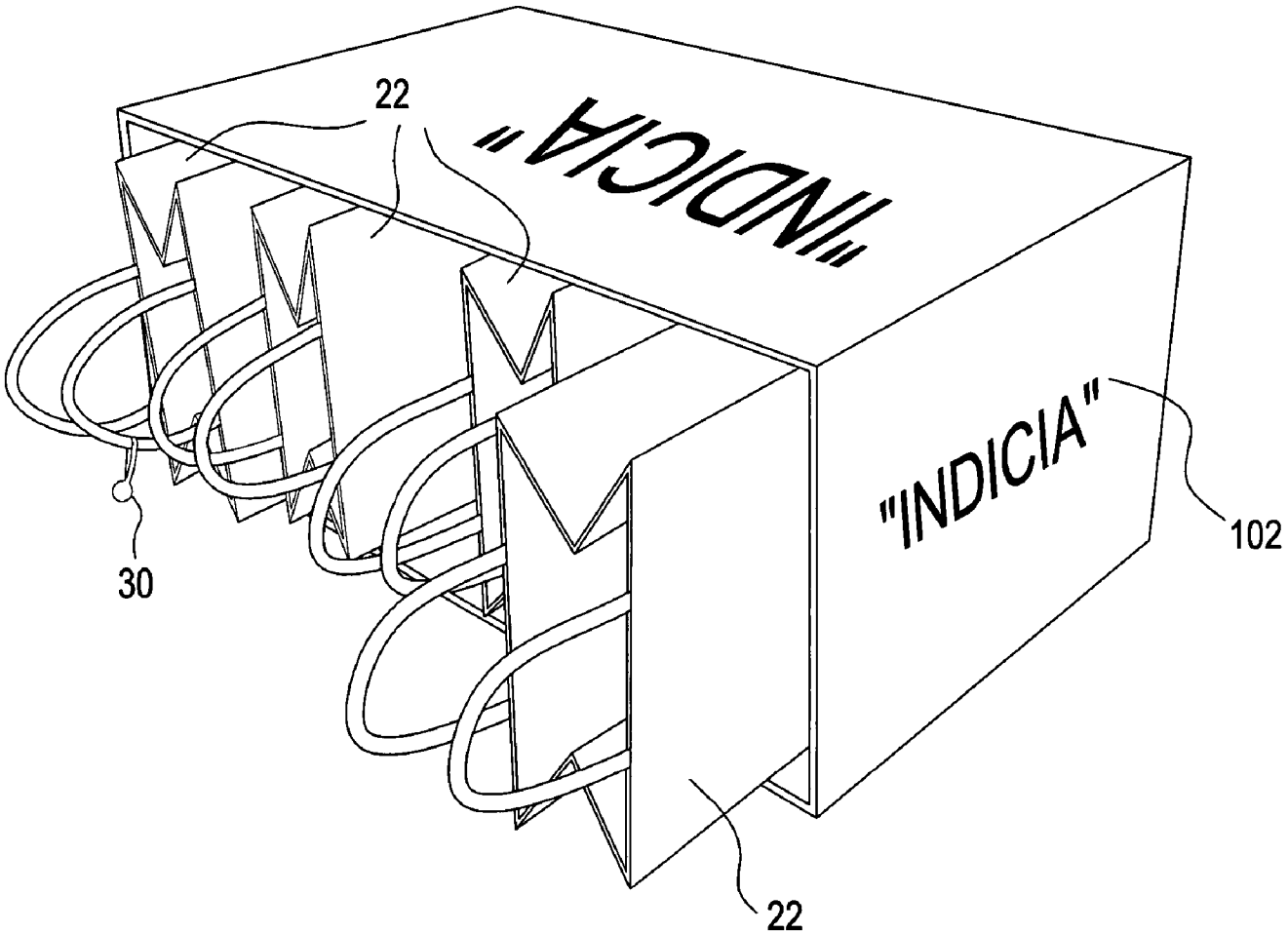
FIGS. 8A-8C shows a display subunit according to some embodiments of the invention.
Figure 8B:
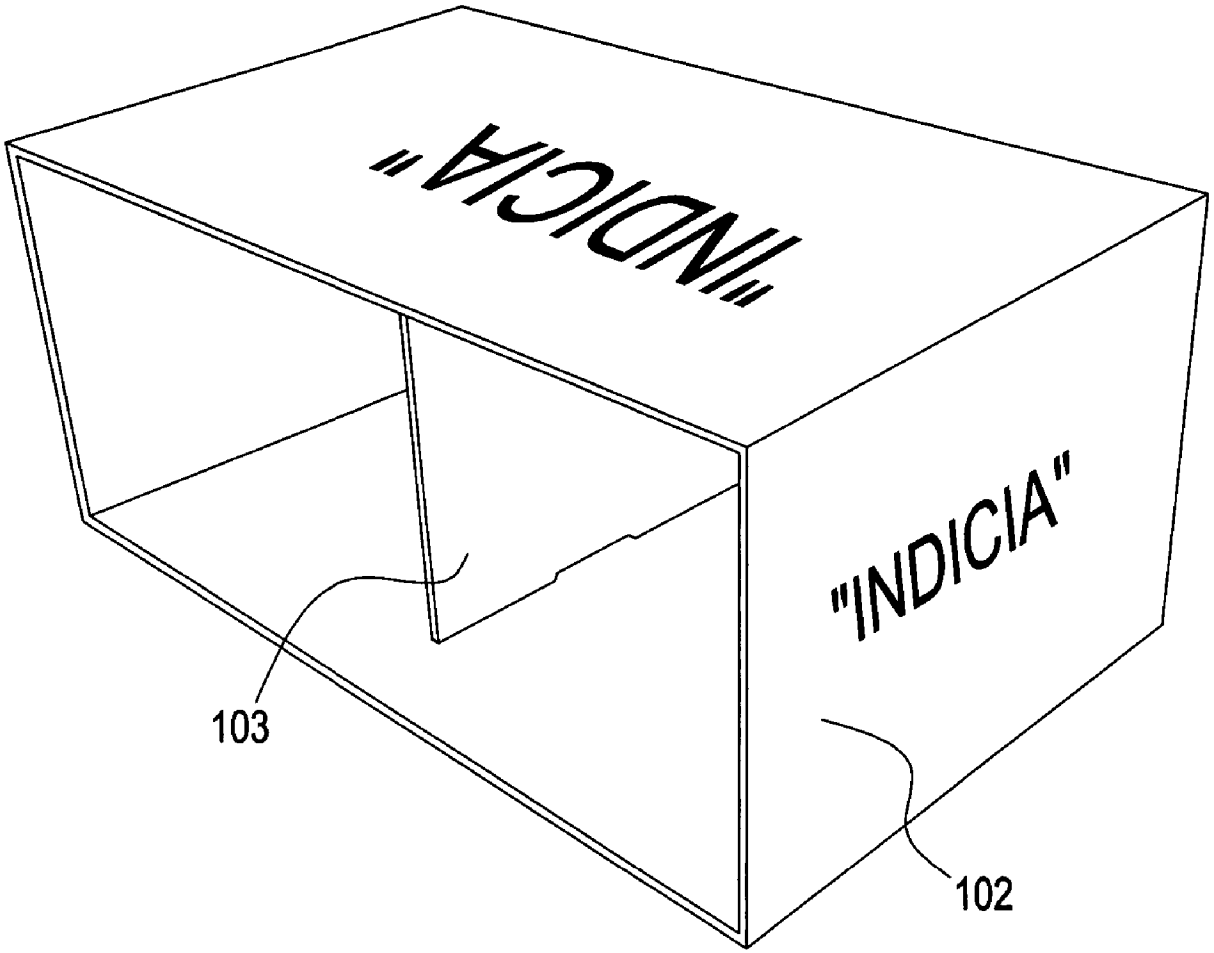
Figure 8C:
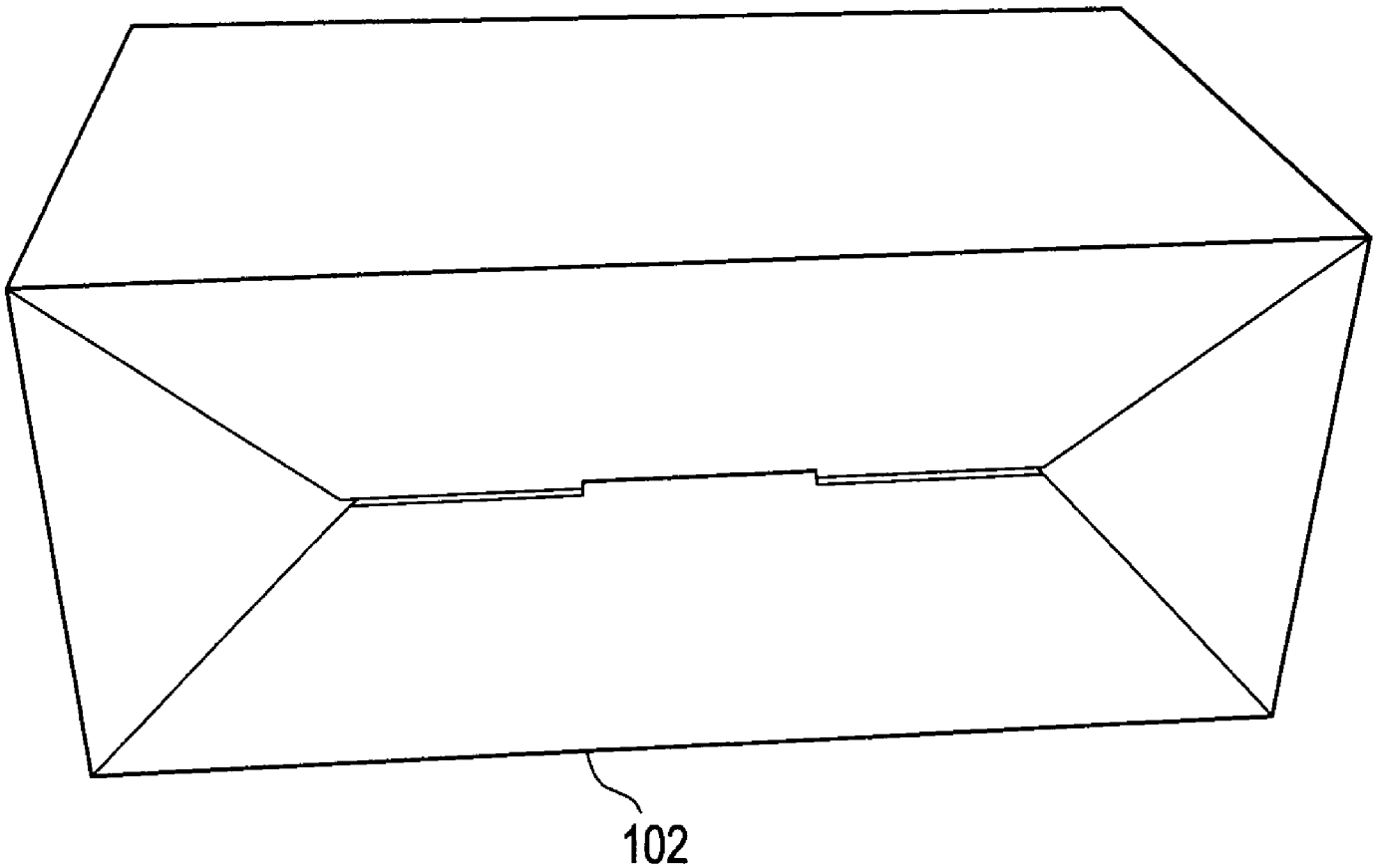
Figure 9:
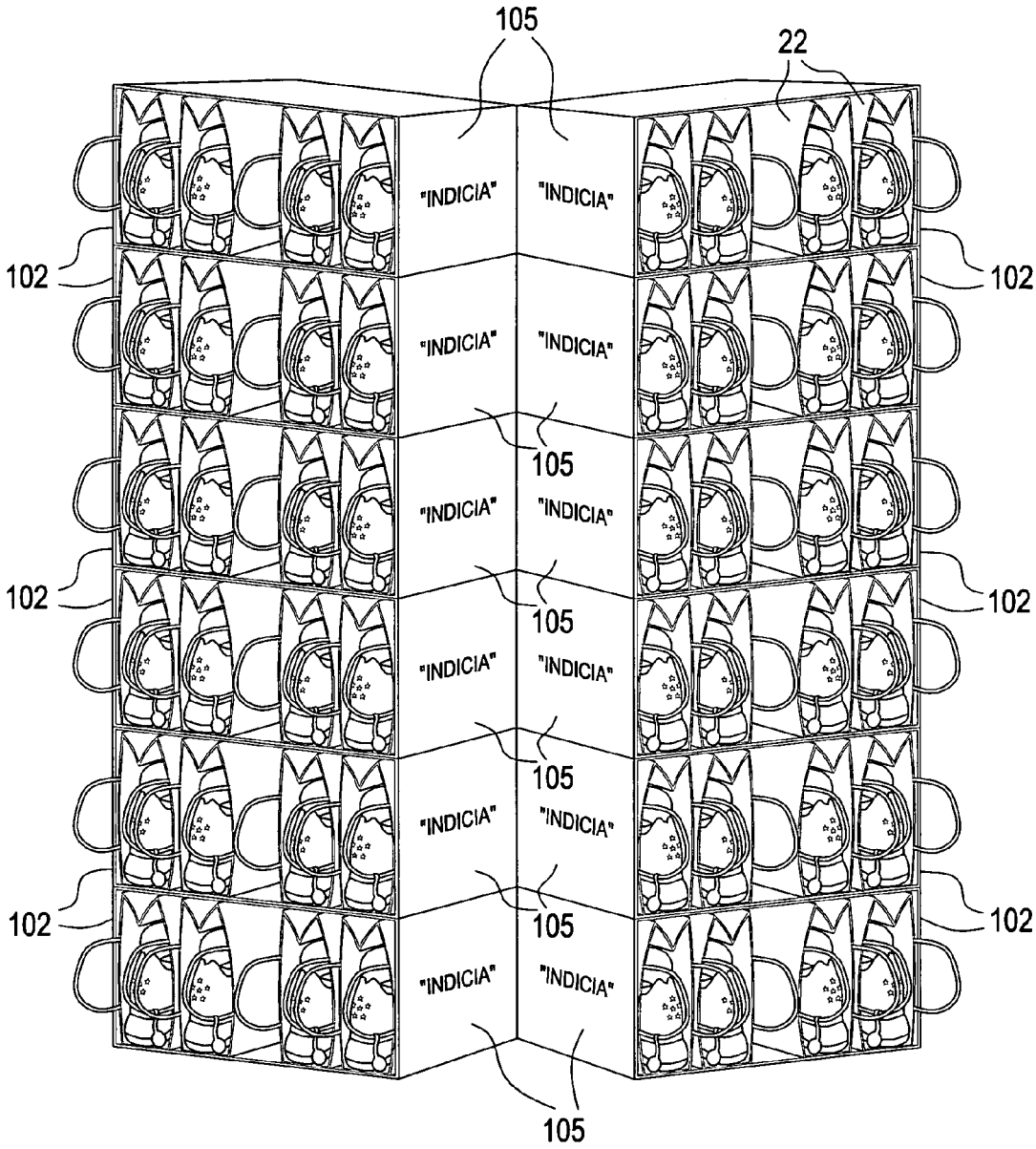
FIG. 9 shows display subunits, according to some embodiments of the invention, arranged in a free-standing display.

Although offering numerous advantages over conventional shoe boxes, shoe bags are not as easily stacked in a display. However, this is readily addressed in various manners. In some cases, displays can be constructed with shelves that are more closely spaced in the vertical direction. In other embodiments, and as also shown in FIG. 7, existing display shelves can be modified with display subunits 102. Each subunit 102 holds a number of shoe bags 22 arranged in a row. Each subunit 102 further has a top and bottom surface that facilitate stacking of multiple subunits. FIGS. 8A-8C show in more detail a subunit 102 according to at least some embodiments of the invention. As seen in FIG. 8A, subunit 102 effectively forms a small cabinet for several bags 22 arranged in a row. FIG. 8B shows subunit 102 without bags 22. FIG. 8C shows the rear of subunit 102. Subunit 102 may be formed from cardboard or other sturdy material. In at least some embodiments, each subunit 102 is fabricated from lithographically laminated E-flute corrugated cardboard. The outer surface of the cardboard may be treated with an aqueous coating, with an oil-based UV-cured coating, or other type of protective coating. For higher durability, a polypropylene laminate could be applied. Subunit 102 is collapsible, and multiple subunits can be supplied to a shoe store location in a flattened or unassembled state. The subunits may then be assembled and located where desired. In some cases, and as shown in FIG. 9, multiple subunits 102 can be stacked to form a free-standing display. As seen in FIG. 9, one collection of vertically arranged subunits 102 can be stacked and placed adjacent to another collection of vertically arranged subunits 102. The vertical stacks may be angularly displaced from one another (as shown) to form an attractive display. In the configuration of FIG. 9, for example, any product name, product logo or other indicia on side panels 105 of subunits 102 is visible to shoppers. Such indicia on side panels 105 can draw attention to (or otherwise highlight) the shoes within the display that are available for purchase. Subunits 102 may also be provided with interlocking tabs (not shown) so that one subunit can be attached to another for a more sturdy display.

Figure 10:
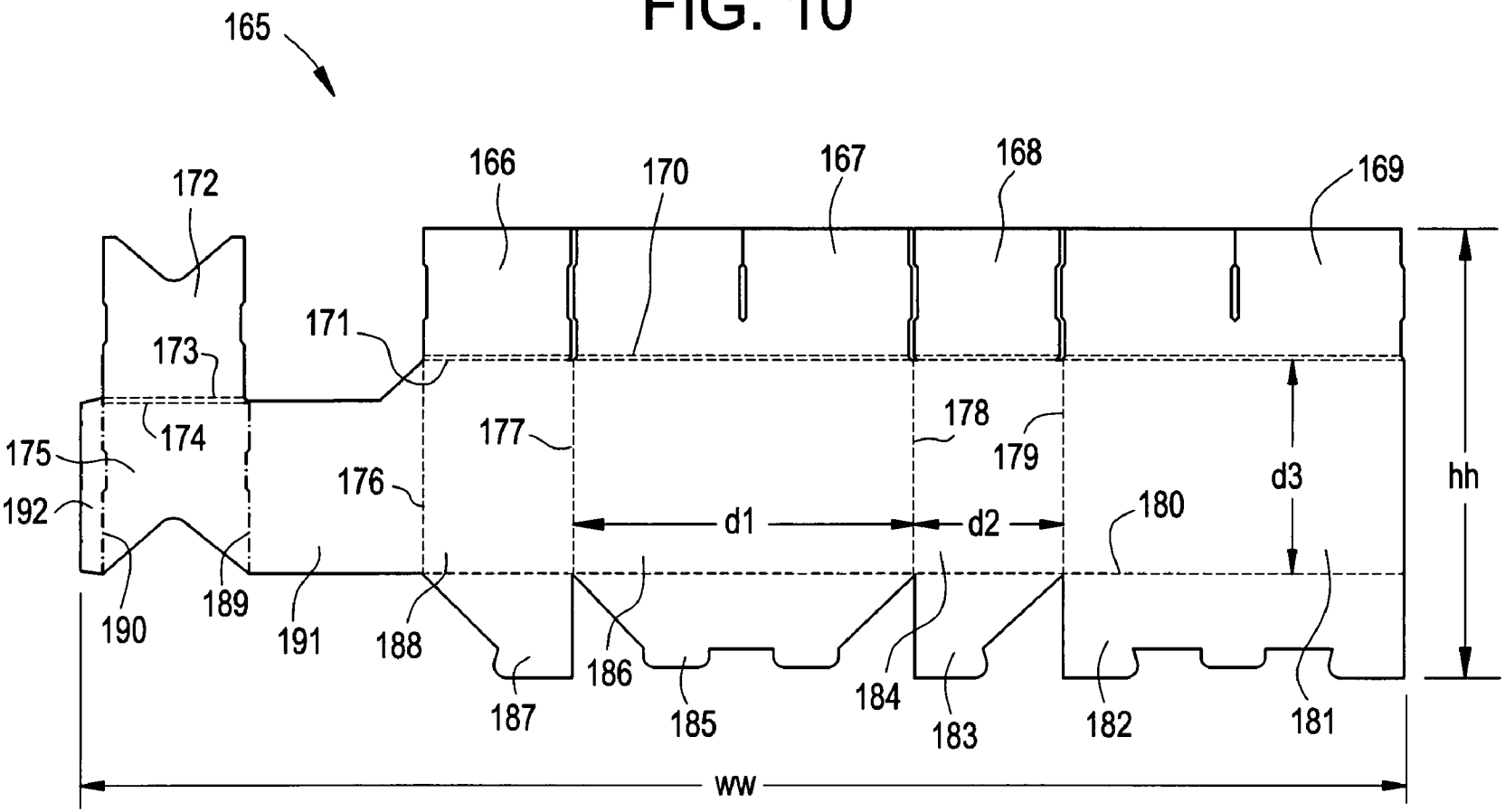
FIG. 10 shows a pattern for the display subunits of FIGS. 8 and 9.

FIG. 10 shows a pattern 165 for a subunit 102. In some embodiments, dimensions for pattern 165 are as set forth in Table 1.

TABLE 1

| | |
|---|---|
| ww | 74.56 inches |
| hh | 24.66 inches |
| d1 | 19.38 inches |
| d2 | 8.38 inches |
| d3 | 11.63 inches |

In at least some embodiments, pattern 165 is cut from 32 ECT E flute CCNB-K-W (clay coated news back). Other possible materials include CCKB (clay coated kraft back), SBS (solid bleached sulfate) board, and white top liners. FIG. 10 shows the surface of pattern 165 which will form the inside of a subunit 102. Solid lines in FIG. 10 represent cut lines. Even broken lines in FIG. 10 represent creases, and uneven broken lines represent combination crease/cut lines (i.e., crease lines with discontinuous cuts along their length). To form a subunit 102, panels 166, 167, 168 and 169 are folded at double crease lines 170 and 171 and laid over panels 188, 186, 184 and 181, respectively. Panel 172 is folded at double crease lines 173 and 174 and laid over panel 175. Panel 192 is folded at combination crease/cut line 190 until it is approximately perpendicular to panels 172 and 175. The combination of panels 172 and 175 are then folded at combination crease/cut line 189 and made approximately perpendicular to panel 191. Panel 191 is next folded at crease line 176 and made approximately perpendicular to panel 188. Panel 188 is subsequently folded at crease line 177 and made approximately perpendicular to panel 186.

At this point, panels 172 and 175 have become the center divider 103 (see FIG. 8B) of a subunit 102. Panel 184 is then folded at crease line 178 and made approximately perpendicular to panel 186. Panel 181 is then folded at crease line 179 until it is approximately perpendicular to panel 184. Panels 187, 185, 183 and 182 are then folded inward and interlocked to form the rear of a subunit 102 (see FIG. 8C). Panels 188 and 184 have become sides of a subunit 102, and panels 186 and 181 have become the top and bottom (respectively) of a subunit 102.

Figure 11:
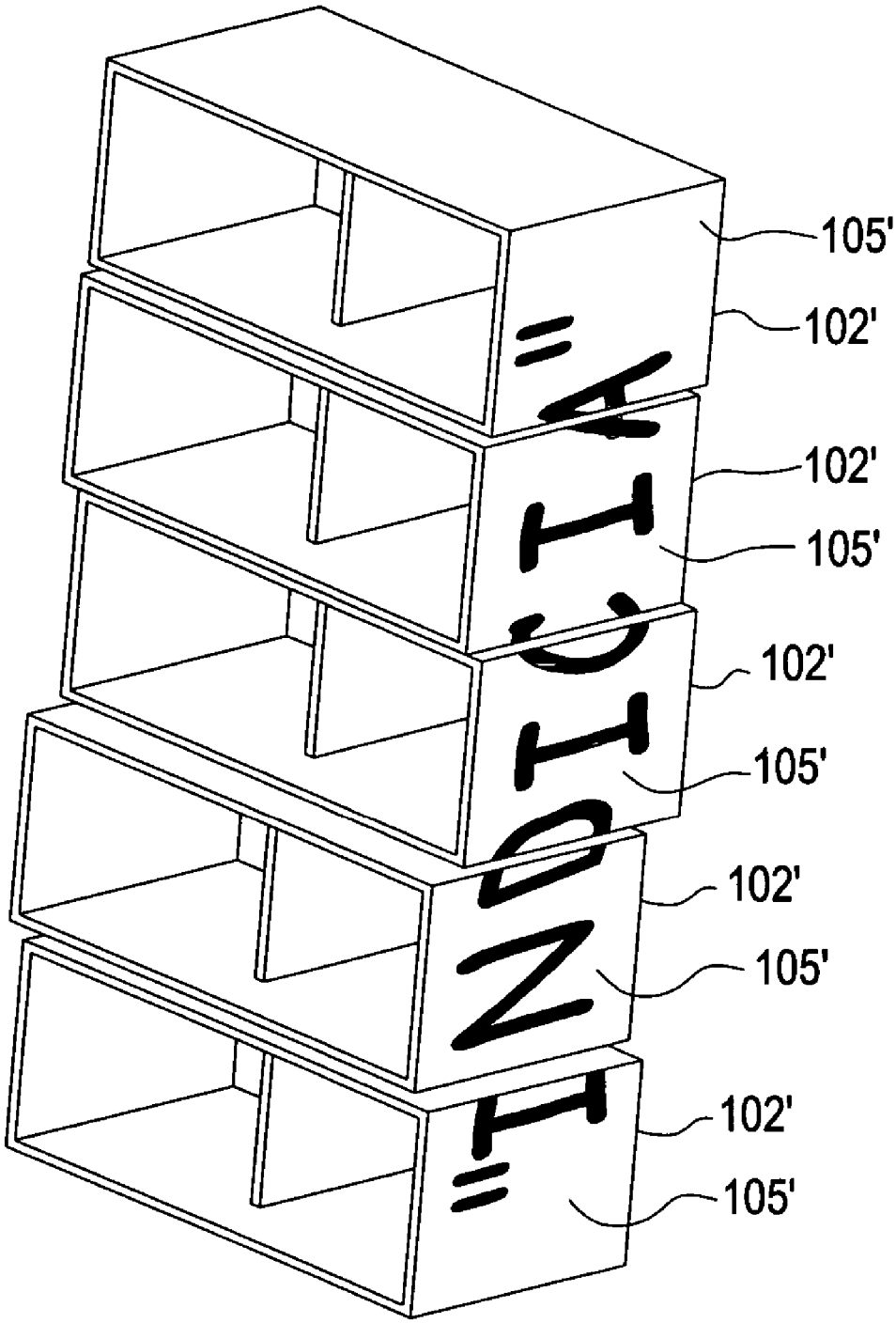
FIG. 11 shows display subunits according to an additional embodiment of the invention.

As seen in FIG. 9, subunits 102 provide an additional location for display of indicia (e.g., advertising or other product information). FIG. 11 shows an alternate embodiment in which each individual subunit has a portion of an overall display printed on its side. In particular, various sides panels 105' of individual subunits 102' have artwork, markings or other indicia that is different from the artwork, markings or other indicia on other subunits' side panels. When the individual subunits 102' are assembled such that side panels 105' are adjacent one another, a unified visual image results from the combined effect of the separate side panels 105'.

As with inclusion of dividers in an MOC (see FIGS. 6A-6C), implementation of subunits such as is shown in FIGS. 7-11 may involve creation of cardboard structures not used when shoes are sold in conventional shoe boxes. However, the cost saving and environmental advantages of the invention remain. When compared against the total amount of paper products needed to form conventional MOCs and shoe boxes, the paper needed for MOCs, display subunits and shoe bags still represents a significant reduction in material usage. Moreover, display subunits such as are shown in FIGS. 7-11 could be used repeatedly. As shoe pairs displayed in the subunits are sold, the subunits could be replenished with additional bagged shoe pairs. As with MOC 72 and MOC dividers 68 and 70 (FIGS. 6A-6C), display subunits such as shown in FIGS. 7-11 will also be a part of the total packaging system that is more likely to be recycled. In particular, shoe retailers (instead of consumers) will generally have responsibility for elimination of worn-out display subunits. Because retailers often have an economic incentive to recycle, those worn-out display subunits are likely to be recycled.

Figure 12:
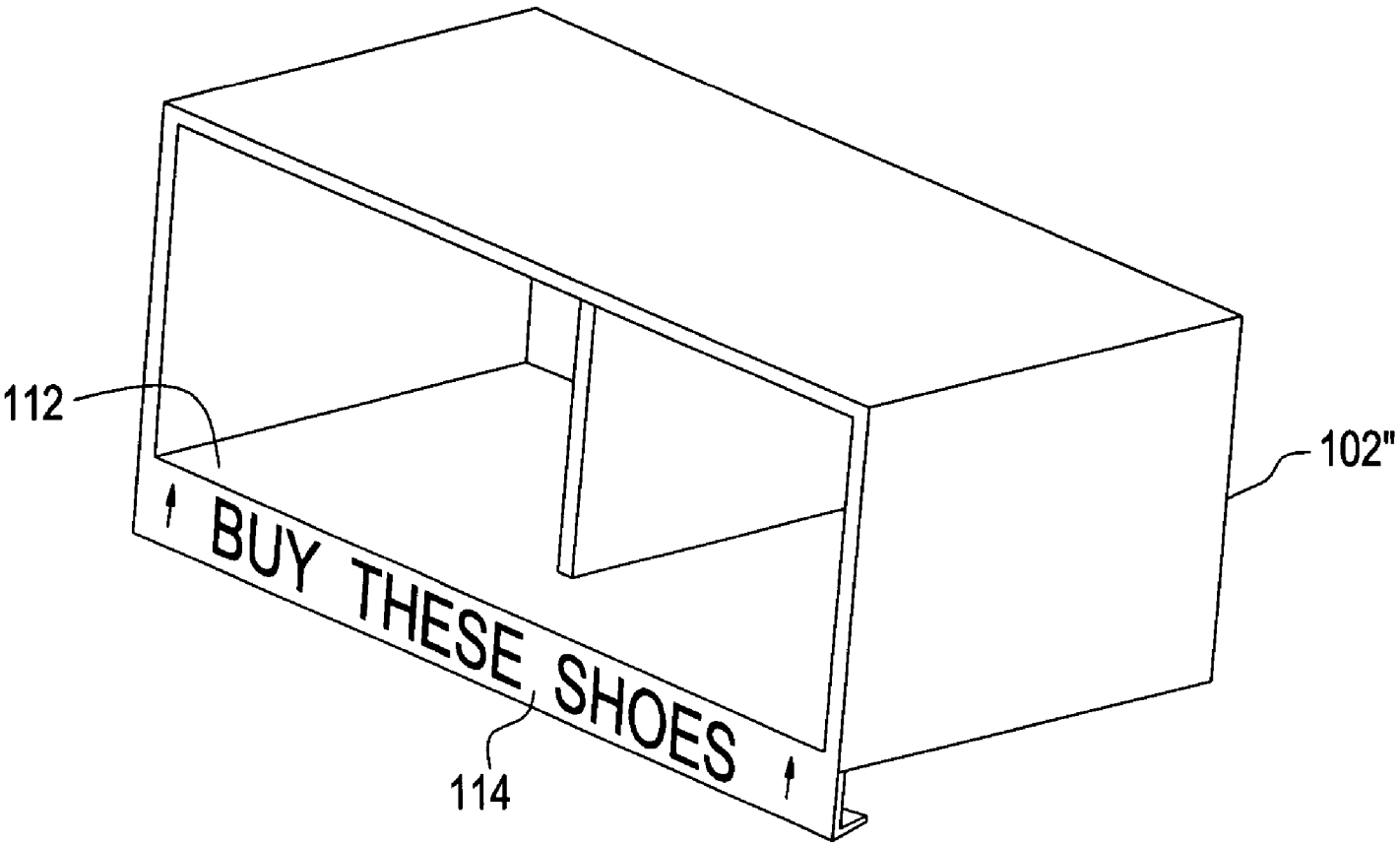
FIG. 12 shows a display subunit according to yet another embodiment of the invention.

In some embodiments, a lower edge of a subunit 102" could be raised slightly (approximately 1.5 inches), as shown in FIG. 12. In this configuration, the front opening 112 of each subunit would be tilted upward, allowing gravity to more securely hold each bag within the subunit. The front face 114 of the lower edge also provides an area for inclusion of additional advertising, product data, artwork or other indicia.

Figure 13A:
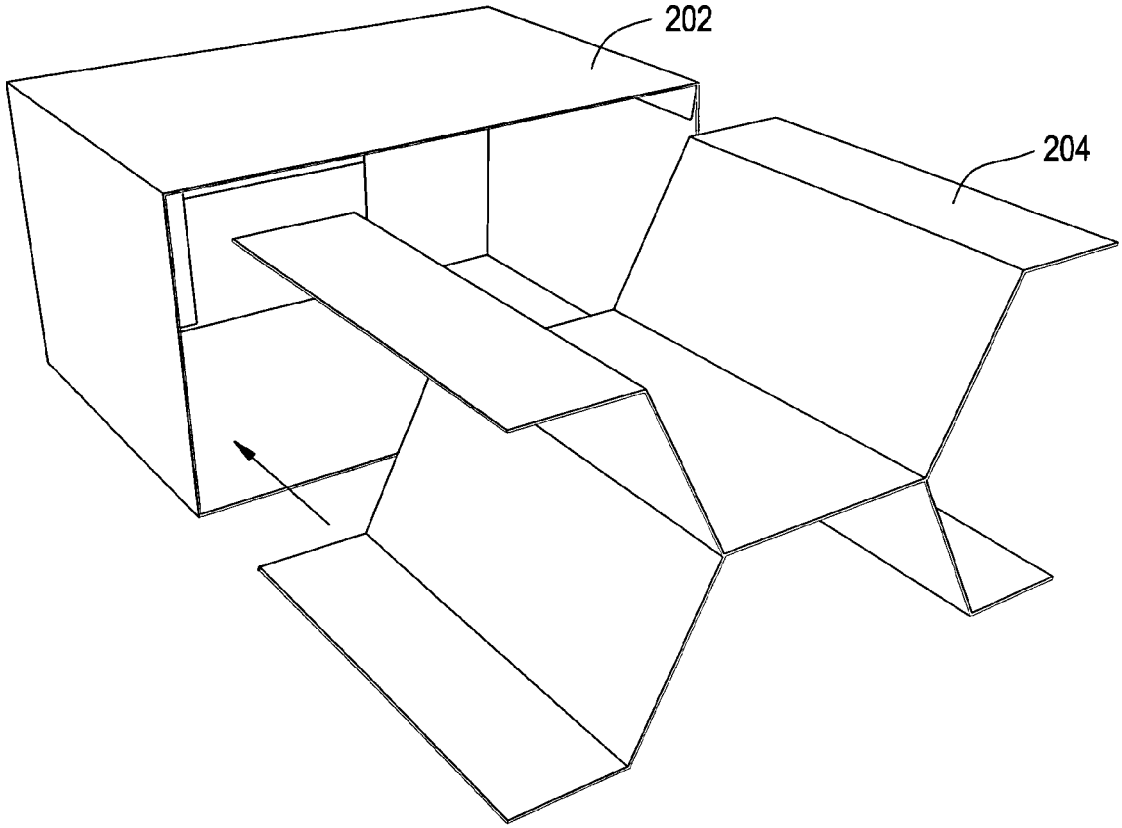
FIGS. 13A and 13B show a combination MOC/display subunit according to other embodiments of the invention.
Figure 13B:
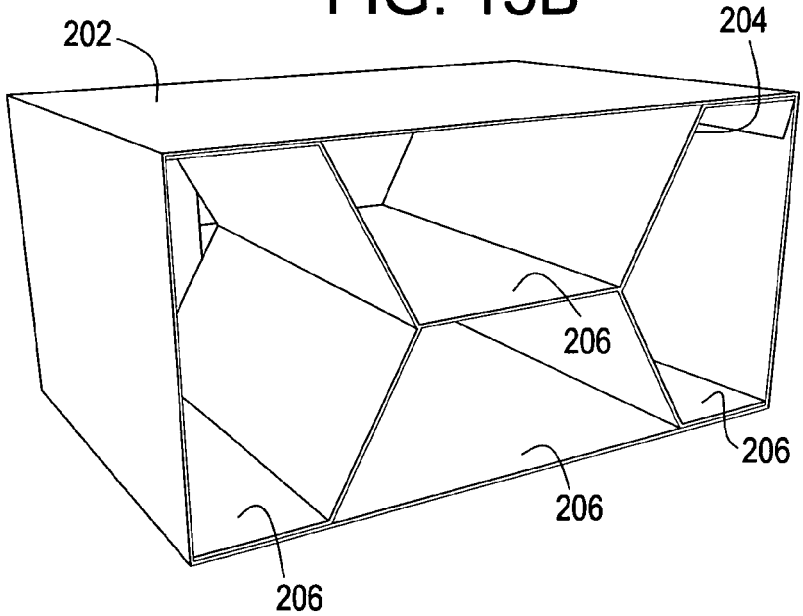

FIG. 13A shows a carton 202 according to additional embodiments of the invention. Carton 202 can be used as both an MOC and as a display subunit. Carton 202 includes a an H-style cardboard divider 204. Once placed inside outer carton 202, and as seen in FIG. 13B, divider 204 forms an array of four cells 206, each of which may hold a pair of shoes contained within a bag 22. A lid (not shown) may be used to cover carton 202 while in transport or storage, and then removed when carton 202 is placed on display. In some embodiments, a single oversize lid is used for two or more cartons 202.

Figure 14A:
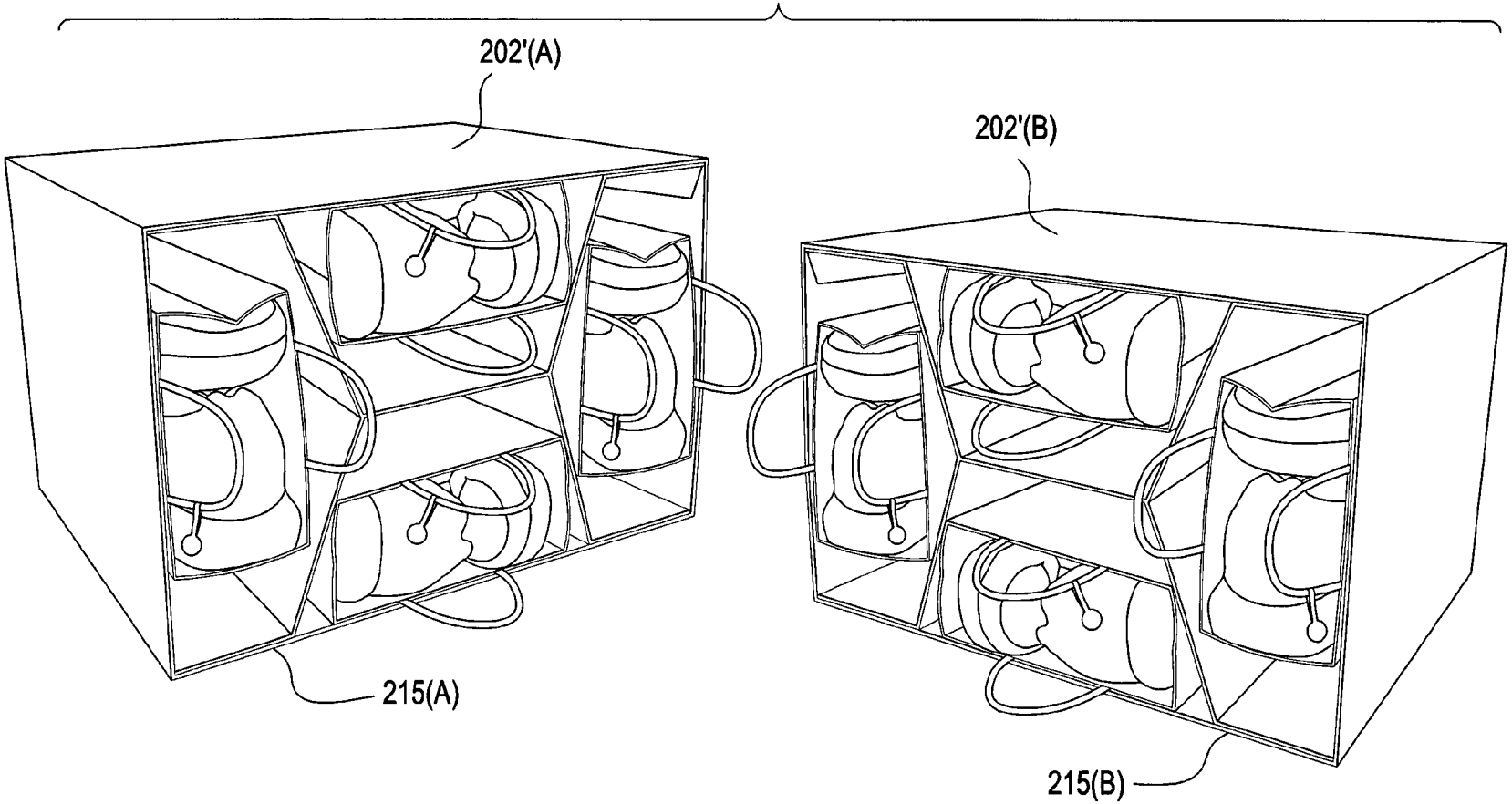
FIGS. 14A and 14B show another embodiment of the combination MOC/display subunit of FIGS. 13A and 13B.
Figure 14B:
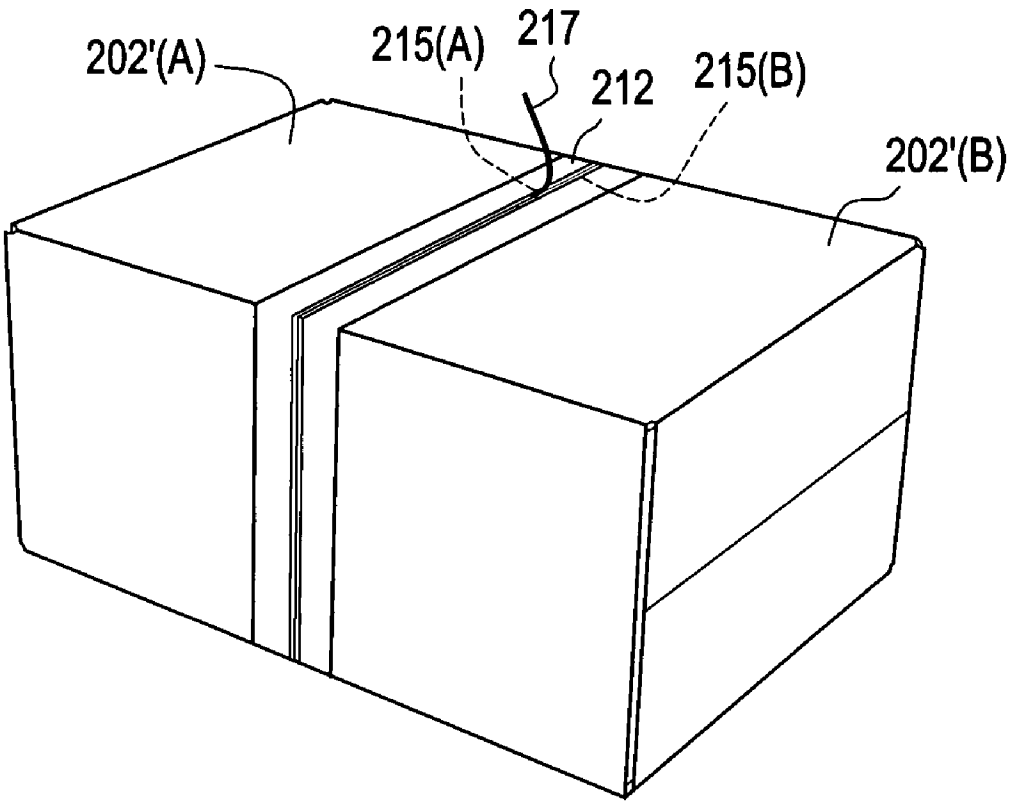

FIG. 14A shows a variation of the embodiment of FIGS. 13A and 13B. Two cartons 202'(A) and 202'(B) are similar to carton 202 of FIGS. 13A and 13B, and have open sides having edges 215(A) and 215(B), respectively. In a shipping configuration shown in FIG. 14B, the open sides of cartons 202'(A) and 202'(B) are placed in an abutting configuration. Edges 215(A) and 215(B) are then joined with a tear-away tape 212. Tear-away tape 212 could be, e.g., an adhesive-backed paper or other material having a cord 217 or other type of filament embedded in a lengthwise direction. By pulling on cord 217 when the joined cartons 202'(A) and 202'(B) reach their destination, the cartons are separated so as to provide two stocked subunits ready for retail (or other) display.

In addition to the cost-saving, environmental and other advantages previously discussed, a retail shoe packaging system using bags instead of shoe boxes offers numerous other benefits. As one example, shoe bags offer an additional opportunity for a shoe manufacturer to advertise. With conventional retail packaging, individual shoe boxes are often placed into a larger shopping bag when the customer makes his or her purchase. This hides the shoe box and any brand name or advertising that may be printed on the shoe box. With shoe bags, however, a customer is less likely to need a separate shopping bag. If a customer leaves a shoe store holding a shoe bag that is not contained inside of a store bag, any brand name or other product information on the shoe bag will be visible by other persons.

As another benefit, shoe bags permit a store to more easily replace packaging which may be damaged by consumers. As previously indicated, customers searching for a pair of shoes sold in a conventional shoe box may open multiple boxes to find the desired pair. In the process, some shoe boxes occasionally become torn or otherwise damaged. When a shoe box is damaged and the shoes therein are not purchased, this may present a problem for the store. Although the shoes inside a damaged box may be unharmed, the damaged box gives the appearance of damaged goods. In some cases, the store may be forced to sell that pair at a discount. As discussed above, shoe bags will reduce the need for consumers to remove multiple shoe pairs from their packages when searching for a pair to purchase. Nevertheless, some removal and replacement of shoes from bags will still occur. For example, a customer may try on a pair of shoes, and then need a different size. Inevitably, some bags may be ripped or otherwise damaged in the process. Because shoe bags are less expensive than shoe boxes, however, a manufacturer can more easily provide extra retail packages (bags) with each shoe shipment.

As yet another advantage, at least some embodiments of the invention allow a shoe manufacturer to reduce the labor needed to pack shoes for shipment. Using conventional shoe boxes, a separate box must be assembled for each shoe pair. In some cases, this requires shoe manufacturers to have staging areas for pre-assembled, stacked shoe boxes. Opening a bag will typically require less effort than assembling a box. If dividers (such as dividers 68 and 70 of FIG. 6B) are used with bags in an MOC, the dividers could be shipped to a factory preassembled and quickly expanded before placement into an MOC.

Figure 15:
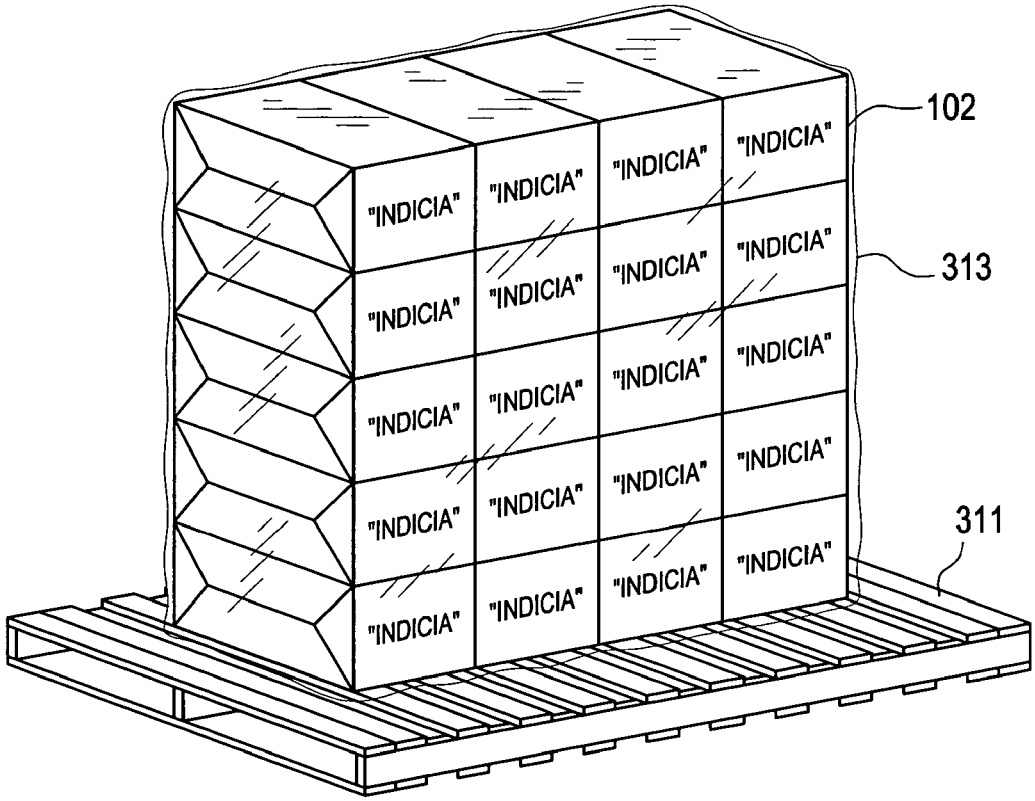
FIG. 15 shows a collection of display subunits stacked on a pallet and wrapped for shipment.

FIG. 15 illustrates an additional advantage of at least some embodiments of the invention. In FIG. 15, multiple display subunits 102 have been pre-filled with shoe pairs packaged as illustrated in FIG. 3 (the shoe pairs are not visible in FIG. 15), and then stacked on a pallet 311 with their open ends facing each other. The stacked subunits are then covered with flexible wrapping material 313 (e.g., polymer film, shrink-wrap, etc.) or other packaging material. The stacked and pre-filled subunits are then ready for shipment. Using this shipping arrangement, the pre-filled subunits can be quickly placed on display after delivery to a retail establishment.

While particular embodiments of the invention have been shown and described, it is recognized that various modifications thereof will occur to those skilled in the art. For example, soy-based inks can be used when printing shoe bags and/or display subunits to reduce environmental impact when these materials are recycled or otherwise disposed of. A piece of cardboard could be placed in the bottom of a shoe bag to increase strength and distribute the load of the shoes more evenly. If dust is a concern, shoes can be placed in a clear polymer inner bag before being placed in a paper bag. These and other modifications are within the scope of the invention.

The invention claimed is:

1. A packaging system for a plurality of shoe pairs, comprising:

a plurality of retail shoe pair packages, each of said packages including a single shoe pair of the plurality disposed within a bag;

a master outer carton, the master outer carton containing the plurality of retail shoe pair packages, wherein the plural retail shoe pair packages are arranged in an array, as to each of the plural retail shoe pair packages, at least a portion of at least one of the shoes within that package is externally visible when that package is removed from the master outer carton, for each retail shoe pair package, the shoes of the shoe pair contained in that package are nested in a configuration in which the toe of one shoe is located over the heel of the other shoe, and for each retail shoe pair package, a portion of the rear of one of the shoes contained therein is visible externally from the shoe pair package when said shoe pair package is removed from the master outer carton;

a display subunit sized to support multiple retail shoe pair packages arranged in a horizontal row, the display subunit being configured for vertical stacking with one or more similar display subunits; and an additional display subunit, wherein each display subunit has at least one side panel having indicia thereon, the indicia on the at least one side panel of one of the display subunits is different from the indicia on the at least one side panel of the other of the display subunits, and the different indicia cooperate to form a unified image when the display subunits are arranged so as to place the side panels having said different indicia in an adjoining configuration.

2. The packaging system of claim 1, wherein the bags of each of the shoe pair packages are formed from paper and have attached handles.

3. The packaging system of claim 1, wherein one or more of the bags includes a closure member at least partially closing an opening of the bag.

* * * * *

UNITED STATES PATENT AND TRADEMARK OFFICE

CERTIFICATE OF CORRECTION

PATENT NO. : 7,581,643 B2
APPLICATION NO. : 11/064056
DATED : September 1, 2009
INVENTOR(S) : Wilskey et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1201 days.

Signed and Sealed this

Fourteenth Day of September, 2010

David J. Kappos

David J. Kappos
*Director of the United States Patent and Trademark Office*